US011508274B2

(12) United States Patent
Choi

(10) Patent No.: US 11,508,274 B2
(45) Date of Patent: Nov. 22, 2022

(54) DISPLAY PANEL DRIVING DEVICE

(71) Applicant: SILICON WORKS CO., LTD., Daejeon (KR)

(72) Inventor: Jung Min Choi, Daejeon (KR)

(73) Assignee: Silicon Works Co., Ltd., Seoul (KR)

( * ) Notice: Subject to any disclaimer, the term of this patent is extended or adjusted under 35 U.S.C. 154(b) by 0 days.

(21) Appl. No.: 17/357,686

(22) Filed: Jun. 24, 2021

(65) Prior Publication Data

US 2021/0407349 A1 Dec. 30, 2021

(30) Foreign Application Priority Data

Jun. 30, 2020 (KR) ..... 10-2020-0080121
Nov. 19, 2020 (KR) ..... 10-2020-0155439

(51) Int. Cl.
*G09G 3/00* (2006.01)
*G09G 3/36* (2006.01)

(52) U.S. Cl.
CPC ..... *G09G 3/006* (2013.01); *G09G 3/3607* (2013.01); *G09G 3/3614* (2013.01); *G09G 3/3696* (2013.01); *G09G 2310/027* (2013.01)

(58) Field of Classification Search
CPC .. G09G 3/006; G09G 2330/12; G09G 3/3607; G09G 3/3614; G09G 3/3696; G09G 2310/027; G09G 2320/0295; G09G 3/3233; G09G 3/3275; G09G 3/3688; G02F 1/1309; G02F 1/136254; G02F 1/136259; G02F 1/136263; H04N 5/202; G01R 31/54; G01R 27/2605; Y10T 29/49004
See application file for complete search history.

(56) References Cited

U.S. PATENT DOCUMENTS 5,113,134 A * 5/1992 Plus ..... G09G 3/006 324/750.3
5,784,042 A * 7/1998 Ono ..... G09G 3/3648 345/94
6,100,865 A * 8/2000 Sasaki ..... G09G 3/3648 345/92
7,053,649 B1 * 5/2006 Osada ..... G09G 3/006 324/750.3
7,265,572 B2 * 9/2007 Osada ..... G09G 3/006 324/760.02
7,317,325 B2 * 1/2008 Brunner ..... G09G 3/006 324/754.22
7,456,647 B2 * 11/2008 Jeon ..... G09G 3/006 324/760.01
8,139,051 B2 * 3/2012 Ando ..... G09G 3/3648 345/204

(Continued)

FOREIGN PATENT DOCUMENTS

JP 3724692 B2 12/2005
KR 10-2009-0103340 A 10/2009

(Continued)

*Primary Examiner* — Michael J Jansen, II
(74) *Attorney, Agent, or Firm* — Fenwick & West LLP

(57) ABSTRACT

The present disclosure relates to a technique for determining a fault of a data line disposed in a display panel using a data driving device. The data driving device may determine a fault of a data line by supplying a data voltage corresponding to a greyscale value to a data line and checking whether another data line is influenced by the data voltage.

20 Claims, 15 Drawing Sheets

(56) References Cited

U.S. PATENT DOCUMENTS 8,159,443 B2 * 4/2012 Lai ..... G09G 3/006 345/100
9,269,285 B2 * 2/2016 Lee ..... G09G 3/006
9,576,512 B2 * 2/2017 Park ..... G09G 3/006
10,380,945 B2 * 8/2019 Hwang ..... G09G 3/3233
10,403,196 B2 * 9/2019 Shin ..... G09G 3/20
10,706,787 B2 * 7/2020 Hyun ..... G01R 31/44
10,832,606 B2 * 11/2020 Kim ..... G09G 3/20
10,997,883 B2 * 5/2021 Kang ..... G09G 3/006
11,011,085 B2 * 5/2021 Lee ..... H01L 27/3276
2006/0125510 A1 * 6/2006 Brunner ..... G09G 3/006 324/754.22
2006/0202923 A1 * 9/2006 Osada ..... G09G 3/006 345/76
2006/0255827 A1 * 11/2006 Nara ..... G09G 3/006 324/762.09
2006/0279510 A1 * 12/2006 Lai ..... G09G 3/006 345/100
2007/0018680 A1 * 1/2007 Jeon ..... G09G 3/006 324/750.3
2008/0180588 A1 * 7/2008 Ando ..... G09G 3/006 349/37
2011/0175800 A1 * 7/2011 Mizumaki ..... H05K 1/0268 345/87
2012/0162165 A1 * 6/2012 Lee ..... G09G 3/006 345/206
2013/0293526 A1 * 11/2013 Igawa ..... G09G 3/3648 345/212
2014/0145739 A1 * 5/2014 Park ..... G09G 3/006 324/750.3
2014/0176844 A1 * 6/2014 Yanagisawa ..... G02F 1/1309 349/43
2016/0379548 A1 * 12/2016 Shin ..... G09G 3/20 345/214
2018/0158413 A1 * 6/2018 Hwang ..... G05F 3/16
2019/0156716 A1 * 5/2019 Kim ..... G09G 3/006
2020/0020281 A1 * 1/2020 Hyun ..... G01R 27/205
2020/0111395 A1 * 4/2020 Kang ..... G09G 3/006
2021/0065595 A1 * 3/2021 Nohtomi ..... G09G 3/3275
2021/0097926 A1 * 4/2021 Sun ..... G09G 3/2074
2021/0209979 A1 * 7/2021 Gao ..... G09G 3/006
2021/0256888 A1 * 8/2021 Zhu ..... G09G 3/006
2021/0286002 A1 * 9/2021 Song ..... G01R 31/31712
2021/0407349 A1 * 12/2021 Choi ..... G09G 3/3696
2022/0108641 A1 * 4/2022 Li ..... H01L 27/3276
2022/0157213 A1 * 5/2022 Bai ..... G09G 3/006

FOREIGN PATENT DOCUMENTS

KR 10-2017-0002098 A 1/2017
KR 10-2019-0059423 A 5/2019

* cited by examiner

DISPLAY PANEL DRIVING DEVICE

CROSS REFERENCE TO RELATED APPLICATION

This application claims priority from Republic of Korea Patent Applications No. 10-2020-0080121 filed on Jun. 30, 2020 and No. 10-2020-0155439 filed on Nov. 19, 2020, which are hereby incorporated by reference in their entirety.

BACKGROUND

1. Field of Technology

The present disclosure relates to a technology for driving and testing a display panel.

2. Description of the Prior Art

On a display panel, a plurality of pixels may be disposed. In addition, a driving device for adjusting greyscales of the pixels may be disposed on a margin of the display panel.

The pixels disposed inside the display panel and the driving device disposed on a margin of the display panel are connected with each other through lines and these lines may be referred to as data lines.

The driving device may receive image data from a data processing device such as a timing controller. A piece of image data includes a greyscale value of each pixel and the driving device may supply a data voltage corresponding to such a greyscale value of each pixel to a data line. A greyscale of each pixel may be adjusted according to such a data voltage.

It is a pixel to display an image. However, when a fault occurs in a data line, a pixel may not properly function. For example, if an open fault occurs in a data line, no data voltage is supplied to a pixel, and thus, the pixel may not function normally. For another example, a short fault occurs in a data line, no data voltage is supplied to a pixel or an excessive level of current is supplied to a pixel, and thus, the pixel may not function normally.

Since the width of a data line is reduced and spaces between data lines become narrow as a display panel has a higher resolution, faults in data lines as described above frequently occur. In order to detect such faults in data lines, according to conventional arts, a test device for detecting faults in data lines is separately provided or a separate test circuit is added inside a display device. However, such a method has problems in that only faults of a display panel in a part where there is a test device can be detected, otherwise manufacturing costs will increases.

SUMMARY OF THE INVENTION

In this background, an aspect of the present disclosure is to provide a technology for testing a display panel in a simple way. Another aspect of the present disclosure is to provide a technology for testing a display panel using a driving device of the display panel.

To this end, in an aspect, the present disclosure provides a device for driving a display panel in which data lines are disposed, comprising: a first channel circuit to supply a first data voltage corresponding to a first greyscale value to a first data line; a second channel circuit to supply a second data voltage corresponding to a second greyscale value different from the first greyscale value to a second data line; a connection circuit to control the connection between the first data line and the second data line; and a control circuit to determine an open fault of the first data line or an open fault of the second data line according to a voltage of the first data line or a voltage of the second data line measured in a state in which the first data line is charged by the first data voltage and the second data line is charged by the second data voltage and the first data line and the second data line share charges by the connection circuit.

The device may further comprise an analog-digital converter and the control circuit may determine an open fault of the first data line or an open fault of the second data line using a value converted by the analog-digital converter from the voltage measured in the first data line or a value converted from the voltage measured in the second data line thereby, the first greyscale value, and the second greyscale value.

In a mode where an image is displayed on the display panel, the first channel circuit and the second channel circuit may change lines of pixels in every 1H (horizontal) time when driving pixels and, in a mode where the open fault is determined, the first channel circuit and the second channel circuit may respectively supply the first data voltage and the second data voltage during at least one 1H time.

The first channel circuit may change the first greyscale value multiple times and the control circuit may determine an open fault of the first data line according to a changed first greyscale value multiple times.

The first channel circuit may supply a third data voltage corresponding to a third greyscale value to the first data line, the second channel circuit may supply a fourth data voltage corresponding to a fourth greyscale value to the second data line, the connection circuit may connect the first data line and the second data line after the third data voltage and the fourth data voltage stop being supplied, and the control circuit may determine an open fault of the first data line using a voltage measured in the first data line in a test for the first greyscale value and a voltage measured in the first data line in a test for the third greyscale value.

In another aspect, the present disclosure provides a method of determining an open fault of a data line by a device for driving a display panel in which data lines are disposed, the method comprising: supplying a first data voltage corresponding to a first greyscale value to a first data line; supplying a second data voltage corresponding to a second greyscale value different from the first greyscale value to a second data line; stopping supplying the first data voltage and the second data voltage; connecting the first data line and the second data line with each other; obtaining a first measured voltage by measuring a voltage of the first data line or a voltage of the second data line; and determining an open fault of the first data line or an open fault of the second data line according to the first measured voltage.

The first data voltage and the second data voltage may respectively have different levels and the third data voltage and the fourth data voltage may respectively have different levels.

In still another aspect, the present disclosure provides a device for driving a display panel in which data lines are disposed, the device comprising: a first channel circuit to supply a first data voltage corresponding to a first greyscale value to a first data line; an analog-digital converter to convert a voltage of a second data line into a first sensing data; and a control circuit to determine a fault of the first data line or a fault of the second data line according to the first sensing data, wherein the display panel comprises a connection circuit to control the connection between the first data line and the second data line.

In still another aspect, the present disclosure provides a device for driving a display panel in which data lines are disposed, the device comprising: a gamma voltage circuit to supply a plurality of gamma voltages; a first channel circuit to generate a first data voltage by selecting a voltage corresponding to a first greyscale value among the plurality of gamma voltages and to supply the first data voltage to a first data line; a first comparator to generate a first reference voltage by selecting a voltage corresponding to a first reference greyscale value among the plurality of gamma voltages and to compare the first reference voltage with a voltage of a second data line; and a control circuit to determine a fault of the first data line or a fault of the second data line according to an output of the first comparator, wherein the display panel comprises a connection circuit to control the connection between the first data line and the second data line.

As described above, according to the present disclosure, tests for a display panel may be performed using a device for driving the display panel, and this allows a testing method to be simple and manufacturing costs to be reduced.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF THE EXEMPLARY EMBODIMENTS

Figure 1:
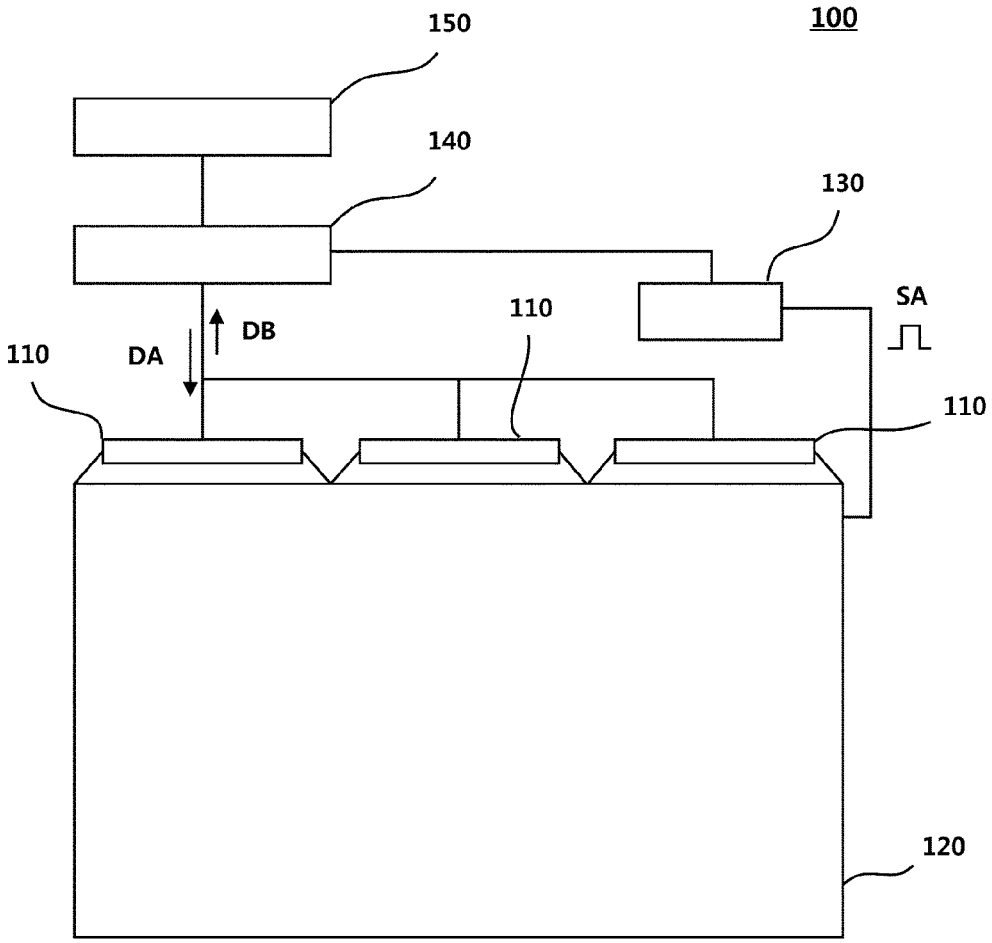
FIG. 1 is a configuration diagram of a display device according to a first embodiment to a fourth embodiment.

FIG. 1 is a configuration diagram of a display device according to a first embodiment to a fourth embodiment.

Referring to FIG. 1, a display device 100 may comprise a display panel 120, a data driving device 110, a level shifter 130, a data processing device 140, and a host device 150.

On the display panel 120, a plurality of pixels may be disposed in a form of a matrix. The display panel 120 may be a liquid crystal display panel or an organic light emitting diode (OLED) panel.

The display panel 120 may comprise a plurality of data lines disposed in one direction (for example, in a vertical direction in FIG. 1) and a plurality of gate lines disposed in another direction (for example, a horizontal direction in FIG. 1). Pixels may respectively be disposed around intersection points of the data lines and the gate lines.

When a turn-on signal is supplied to a pixel through a gate line, a transistor disposed in the pixel is turned on and a data line is connected with the pixel and when a turn-off signal is supplied, the data line is disconnected from the pixel. Such a turn-on signal may be referred to as a scan signal.

The data driving device 110 may supply a data voltage to a data line. The data driving device 110 may comprise a plurality of channel circuits. Each channel circuit may be connected with a data line and supply a data voltage to a data line.

The data driving device 110 may receive image data DA from the data processing device 140. Image data DA may include a greyscale value of each pixel. The channel circuit may generate a data voltage corresponding to the greyscale value and transmit the data voltage to a data line. The data line may be connected with a pixel according to a scan signal and the data voltage may be supplied to the pixel connected with the data line. Depending on the data voltage, a greyscale of the pixel may be adjusted.

The data driving device 110 may comprise a plurality of integrated circuits and a predetermined number of data lines may be assigned to each integrated circuit to be connected thereto.

The data driving device 110 may comprise an analog-digital converter (ADC). The data driving device 110 may sense characteristics of a pixel using the analog-digital converter and transmit pixel characteristic sensing data to the data processing device 140. The data processing device 140 may compensate for image data appropriately for the characteristics of the pixel according to the pixel characteristic sensing data and transmit compensated image data DA to the data driving device 110. In particular, in a case when the display panel 120 is an OLED panel, the data driving device 110 may sense differences in characteristics or deterioration degrees of pixels and the data processing device 140 may compensate for image data such that the differences in characteristics or the deterioration degrees are reflected.

The display panel 120 may further comprise touch sensors and the data driving device 110 may further comprise a touch driving circuit to drive the touch sensors. The touch driving circuit may comprise the analog-digital converter described above. The touch driving circuit may supply a touch driving signal to a touch sensor and receive a response signal to the touch driving signal from the touch sensor. In addition, the touch driving circuit may convert the response signal into touch sensing data using the analog-digital converter and transmit the touch sensing data to another device.

The data driving device 110 may determine a fault of a data line. The data driving device 110 may determine a fault of a first data line or a fault of a second data line using the first data line and the second data line. Here, a fault may be an open fault, meaning that a line is disconnected, or a short fault, meaning that two lines are electrically connected.

The data driving device 110 may supply a data voltage to a data line. A fault of a data line may be determined using such a function. Specifically, the data driving device 110 may supply a first data voltage to the first data line and measure influence of the first data voltage on the second data line to determine a fault of the first data line or a fault of the second data line. The data driving device 110 may determine the aforementioned faults using a voltage of the second data line. To this end, the analog-digital converter may be used or a separate comparator may be used.

The display panel 120 may further comprise a connection circuit to support a test for faults. The connection circuit may connect or disconnect the first data line and the second data line.

In a state where the first data line and the second data line are connected by the connection circuit, the data driving device 110 may supply the first data voltage to the first data line and check if a voltage corresponding to the first data voltage is measured in the second data line. When a voltage corresponding to the first data voltage is measured in the second data line, the data driving device 110 may determine the first data line and the second data line to be in a normal condition and when a voltage measured in the second data line does not correspond to the first data voltage, the data driving device 110 may determine that the first data line has an open fault or the second data line has an open fault.

The connection circuit may comprise a switch and the level shifter 130 may supply an on-off signal SA for the switch. The level shifter 130 may receive a switch control signal from the data processing device 140 or another device, generate an on-off signal SA according to the switch control signal, and transmit the on-off signal SA to the connection circuit.

The data driving device 110 may operate in a normal mode and in a test mode.

In the normal mode, the data driving device 110 may receive image data DA from the data processing device 140, generate a data voltage using the image data DA, and transmit the data voltage to a data line so as to adjust a greyscale of a pixel.

In the test mode, the data driving device 110 may receive a control signal for the test mode from the data processing device 140. Subsequently, the data driving device 110 may convert a first greyscale value, which is previously determined or in accordance with the control signal, into a first data voltage and supply the first data voltage to the first data line. After that, the data driving device 110 may determine a fault of the first data line or a fault of the second data line using a voltage of the second data line.

The host device 150 may enter the test mode according to a user operating signal inputted from an external device and control the data processing device 140 to operate in the test mode. The data processing device 140 may transmit a control signal to the data driving device 110 and the level shifter 130 in the test mode. The data driving device 110 may transmit state determination data DB to determine a fault of a data line to the data processing device 140. The data processing device 140 may transmit the state determination data DB to the host device 150.

Figure 2:
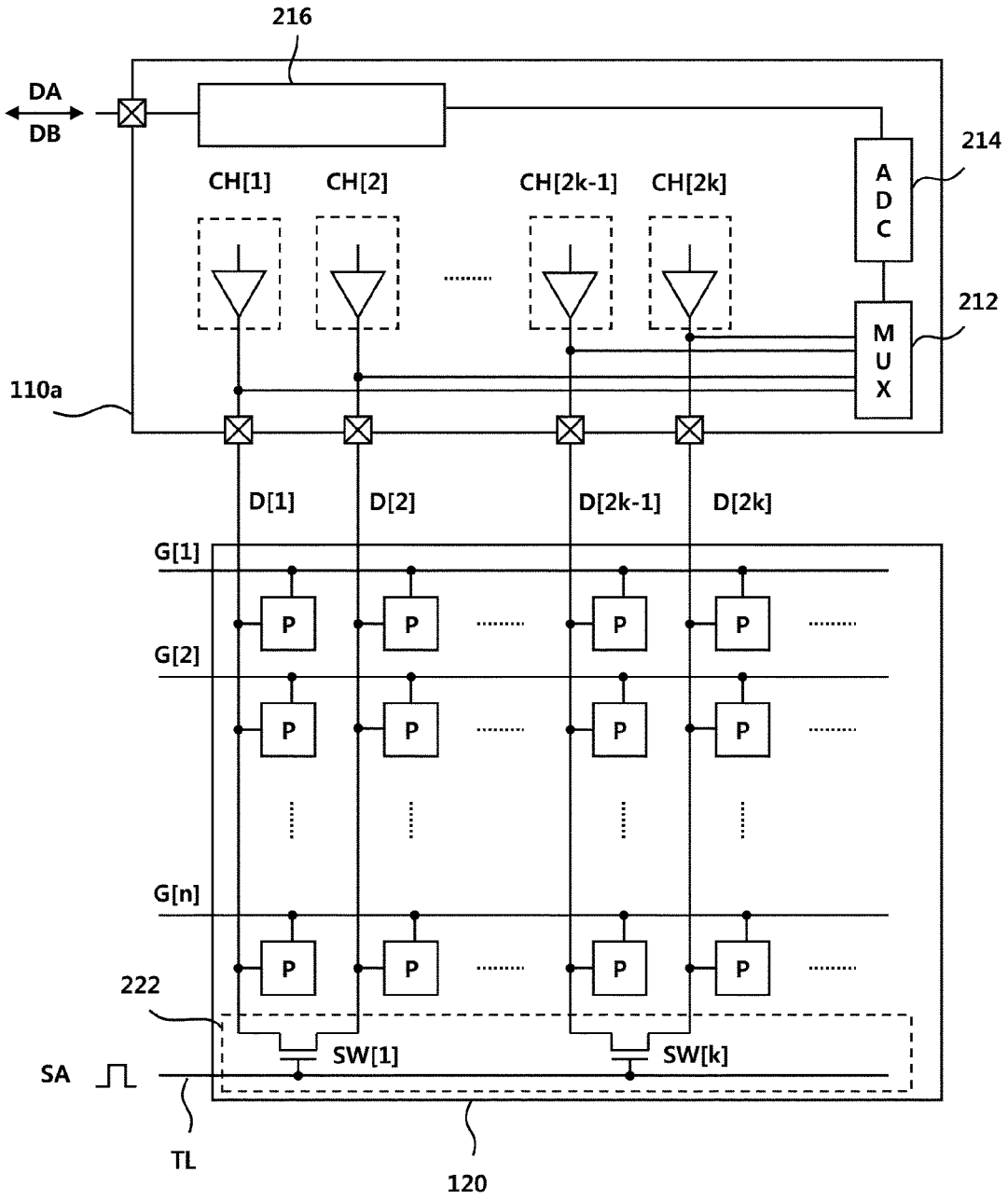
FIG. 2 is a configuration diagram of a data driving device and a display panel according to a first embodiment.

FIG. 2 is a configuration diagram of a data driving device and a display panel according to a first embodiment.

Referring to FIG. 2, a data driving device 110*a* may comprise a plurality of channel circuits CH[1], CH[2], . . . CH[2k−1], CH[2k], . . . , a selecting circuit 212, an analog-digital converter 214, and a control circuit 216. On the display panel 120, a plurality of gate lines G[1], G[2], . . . , G[n] and a plurality of data lines D[1], D[2], . . . , D[2k−1], D[2k], . . . may be disposed and pixels P may be disposed where the gate lines G[1], G[2], . . . , G[n] and the data lines D[1], D[2], . . . , D[2k−1], D[2k], . . . intersect with each other. The display panel 120 may further comprise a connection circuit 222.

The control circuit 216 may receive image data DA from an external device and transmit greyscale values of pixels included in the image data DA to the respective channel circuits CH[1], CH[2], . . . , CH[2k−1], CH[2k], . . . . The channel circuits CH[1], CH[2], . . . , CH[2k−1], CH[2k], . . . may supply data voltages corresponding to the greyscale values respectively to the data lines D[1], D[2], . . . , D[2k−1], D[2k], . . . .

When a scan signal is supplied to a first gate line G[1], pixels connected with the first gate line G[1] may be connected with the data lines D[1], D[2], . . . , D[2k−1], D[2k], and the channel circuits CH[1], CH[2], . . . , CH[2k−1], CH[2k], . . . may respectively supply data voltages corresponding to greyscale values to be displayed in pixels in a corresponding line to the data lines D[1], D[2], . . . , D[2k−1], D[2k], . . . .

In the test mode, no scan signal may be supplied to the gate lines G[1], G[2], . . . , G[n] and no pixel P may be connected with the data lines D[1], D[2], . . . , D[2k−1], D[2k], . . . .

In the test mode, the control circuit 216 may operate the respective channel circuits CH[1], CH[2], . . . , CH[2k−1], CH[2k], . . . , the selecting circuit 212, and the analog-digital converter 214 in the test mode, generate state determination data DB, and transmit the same to an external device.

In the test mode, every two data lines may be operated as a pair. In a first test time, a data voltage may be supplied to one of the two data lines and a voltage may be measured in the other data line. In a second test time, a data voltage may be supplied to the other data line and a voltage may be measured in the one data line. The selecting circuit 212 may connect the other data line with the analog-digital converter 214 in the first test time and the one data line with the analog-digital converter 214 in the second test time. The analog-digital converter 214 may convert voltages of data lines connected with the analog-digital converter 214 into sensing data and transmit the sensing data to the control circuit 216 and the control circuit 216 may determine faults of the data lines D[1], D[2], . . . , D[2k−1], D[2k], . . . based on the sensing data.

In the connection circuit 222, switches SW[1], . . . , SW[k], . . . may be disposed. The switches SW[1], . . . , SW[k], . . . may be disposed on the opposite side to that of the channel circuits CH[1], CH[2], . . . , CH[2k−1], CH[2k], . . . in a longitudinal direction of the data lines D[1], D[2], . . . , D[2k−1], D[2k], . . . . For example, output terminals of the channel circuits CH[1], CH[2], . . . , CH[2k−1], CH[2k], . . . may be connected with upper ends of the data lines D[1], D[2], . . . , D[2k−1], D[2k], . . . and the switches SW[1], . . . , SW[k], . . . may be connected with lower ends of the data lines D[1], D[2], . . . , D[2k−1], D[2k], . . . .

The switches SW[1], . . . , SW[k], . . . may control connection between two data lines. The switches SW[1], . . . , SW[1], . . . may be turned on or off according to an on-off signal SA supplied through a test control line TL. When the switches SW[1], . . . , SW[k], . . . are turned on, the two data lines may be connected with each other and when the switches SW[1], . . . , SW[k], . . . are turned off, the two data lines may be disconnected from each other.

The data driving device 110*a* may determine open faults of the data lines D[1], D[2], . . . , D[2k−1], D[2k], . . . in a state where the switches SW[1], . . . , SW[k], . . . are turned on and it may determine short faults of the data lines D[1], D[2], . . . , D[2k−1], D[2k], . . . in a state where the switches SW[1], SW[k], . . . are turned off.

Figure 3:
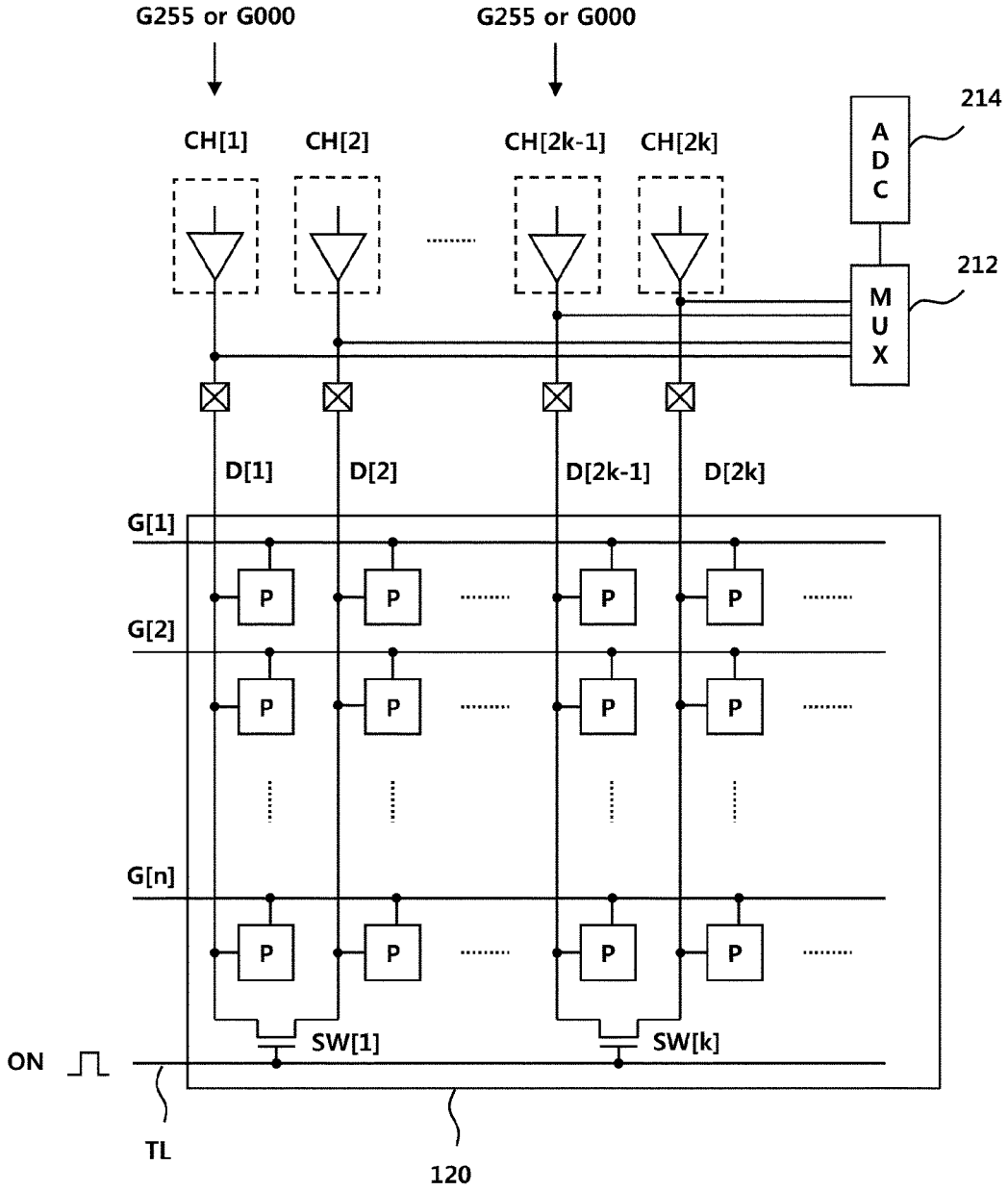
FIG. 3 is a diagram illustrating a first exemplary test state of a data driving device and a display panel according to a first embodiment.

FIG. 3 is a diagram illustrating a first exemplary test state of a data driving device and a display panel according to a first embodiment.

Referring to FIG. 3, in the first exemplary test state, an odd-numbered channel circuit CH[2k−1] (k is a natural number) may supply a first data voltage corresponding to a first greyscale value to an odd-numbered data line D[2k−1].

In addition, the switches SW[1], . . . , SW[k], . . . disposed in the connection circuit may be turned on so that a 2k-lth data line D[2k−1] may be connected with a 2kth data line D[2k].

The selecting circuit 212 may connect the even-numbered data line D[2k] with the analog-digital converter 214.

The analog-digital converter 214 may convert a voltage of the even-numbered data line D[2k] into sensing data.

The first greyscale value may be a maximum greyscale value, for example, G255 or a minimum greyscale value, for example, G000.

In this first exemplary test state, the control circuit may determine open faults of the data lines D[1], D[2], . . . , D[2k−1], D[2k], . . . based on the sensing data. For example, the control circuit may determine a data line to be in a normal condition if a sensing value included in the sensing data is higher than a reference value and determine the data line to have an open fault if the sensing value is lower than the reference value. Here, the reference value is determined according to the first greyscale value and may be set to be higher as the first greyscale value is higher.

The data driving device may perform tests for the odd-numbered data lines D[2k−1] in the first test time and tests for the even-numbered data lines D[2k] in the second test time.

In the second test time, an even-numbered channel circuit CH[2k] may supply a second data voltage corresponding to a second greyscale value to the even-numbered data line D[2k].

In addition, the switches SW[1], . . . , SW[k], . . . disposed in the connection circuit may be turned on so that the 2k-lth data line D[2k−1] and the 2kth data line D[2k] may be connected with each other.

The selecting circuit 212 may connect the odd-numbered data line D[2k−1] with the analog-digital converter 214.

The analog-digital converter 214 may convert a voltage of the odd-numbered data line D[2k−1] into sensing data.

After the first test time and the second test time have elapsed, the control circuit may gather pieces of the sensing data and determine open faults of the data lines D[1], D[2], . . . , D[2k−1], D[2k], . . . .

The first data voltage and the second data voltage may be identical or respectively have opposite polarities.

All the odd-numbered data lines D[2k−1] and/or all the even-numbered data lines D[2k] may simultaneously be driven or may be divided into parts and driven by part depending on embodiments. In a case when they are driven by part, the selecting circuit 212 may select data lines to be sensed.

Figure 4:
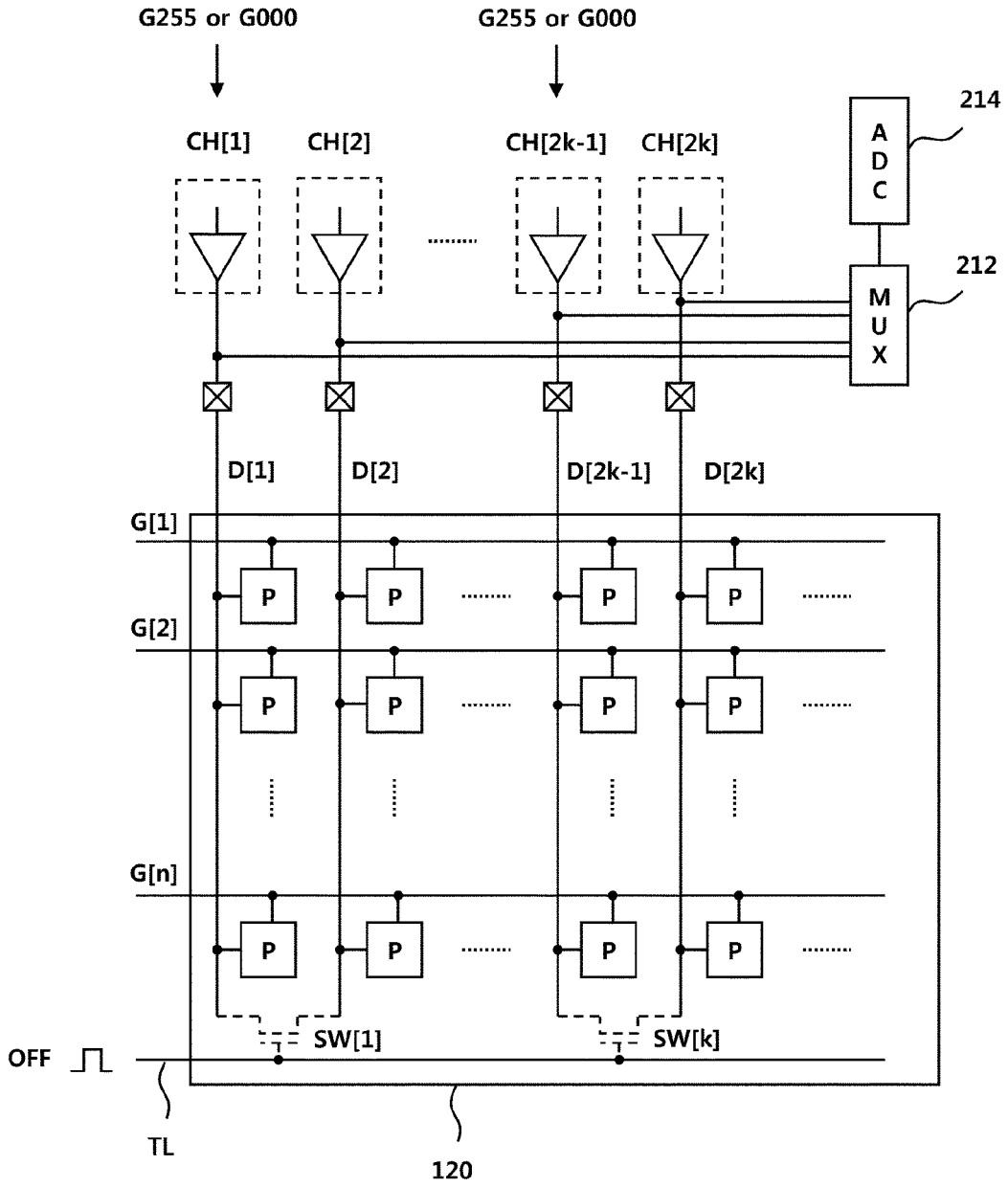
FIG. 4 is a diagram illustrating a second exemplary test state of a data driving device and a display panel according to a first embodiment.

FIG. 4 is a diagram illustrating a second exemplary test state of a data driving device and a display panel according to a first embodiment.

Referring to FIG. 4, in the second exemplary test state, the odd-numbered channel circuit CH[2k−1] (k is a natural number) may supply a first data voltage corresponding to a first greyscale value to the odd-numbered data line D[2k−1].

In addition, the switches SW[1], . . . , SW[k], . . . disposed in the connection circuit may be turned off so that the 2k-lth data line D[2k−1] and the 2kth data line D[2k] may be disconnected from each other.

The selecting circuit 212 may connect the even-numbered data line D[2k] to the analog-digital converter 214.

The analog-digital converter 214 may convert a voltage of the even-numbered data line D[2k] into sensing data.

The first greyscale value may be a maximum greyscale value, for example, G255 or a minimum greyscale value, for example, G000.

In this second exemplary test state, the control circuit may determine a short fault of the 2k-lth data lines D[2k−1] or a short fault of the 2kth data line D[2k] based on the sensing data. For example, the control circuit may determine a data line to be in a normal condition if a sensing value included in the sensing data is lower than a reference value and determine the data line to have a short fault if the sensing value is higher than the reference value. Here, the reference value is determined according to the first greyscale value and may be set to be higher as the first greyscale value is higher. Depending on embodiments, the reference value may be fixed.

The data driving device may perform tests for the odd-numbered data lines D[2k−1] in the first test time and tests for the even-numbered data lines D[2k] in the second test time.

In the second test time, the even-numbered channel circuit CH[2k] may supply second data voltages corresponding to a second greyscale value to the even-numbered data line D[2k].

In addition, the switches SW[1], . . . , SW[k], . . . disposed in the connection circuit may be turned off so that the 2k-lth data line D[2k−1] and the 2kth data line D[2k] may be disconnected from each other.

The selecting circuit 212 may connect the odd-numbered data line D[2k−1] with the analog-digital converter 214.

The analog-digital converter 214 may convert a voltage of the odd-numbered data line D[2k−1] into sensing data.

After the first test time and the second test time have elapsed, the control circuit may gather pieces of the sensing data and determine short faults of the data lines D[1], D[2], . . . , D[2k−1], D[2k], . . . .

The first data voltage and the second data voltage may be identical or respectively have opposite polarities.

All the odd-numbered data lines D[2k−1] and/or all the even-numbered data lines D[2k] may simultaneously be driven or may be divided into parts and driven by part depending on embodiments. In a case when they are driven by part, the selecting circuit 212 may select data lines to be sensed.

Figure 5:
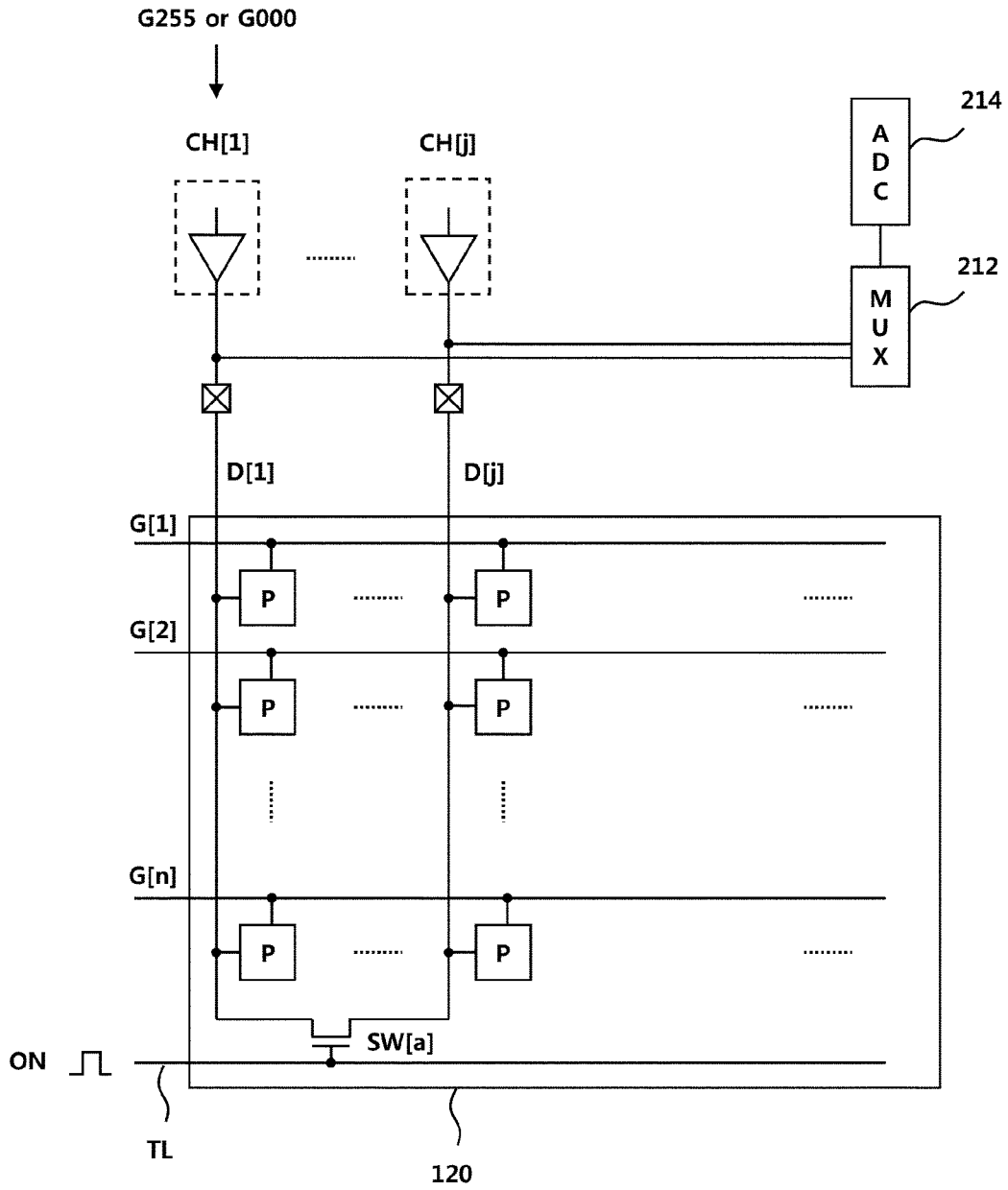
FIG. 5 is a diagram illustrating a third exemplary test state of a data driving device and a display panel according to a first embodiment.

FIG. 5 is a diagram illustrating a third exemplary test state of a data driving device and a display panel according to a first embodiment.

Referring to FIG. 5, in the third exemplary test state, a switch SW[a] may connect two non-adjacent data lines, unlike in the first exemplary test state. For example, the switch SW[a] may connect a first data line D[1] and a jth data line D[j] (j is a natural number equal to or higher than 3) with each other.

A testing process may be the same as that of the first exemplary test.

A data voltage may be supplied to one of the two non-adjacent data lines and a voltage of the other data line may be converted into first sensing data in the first test time. A data voltage may be supplied to the other data line and a voltage of the one data line may be converted into second sensing data in the second test time. Subsequently, the control circuit may determine open faults of the two data lines using the first sensing data and the second sensing data.

Figure 6:
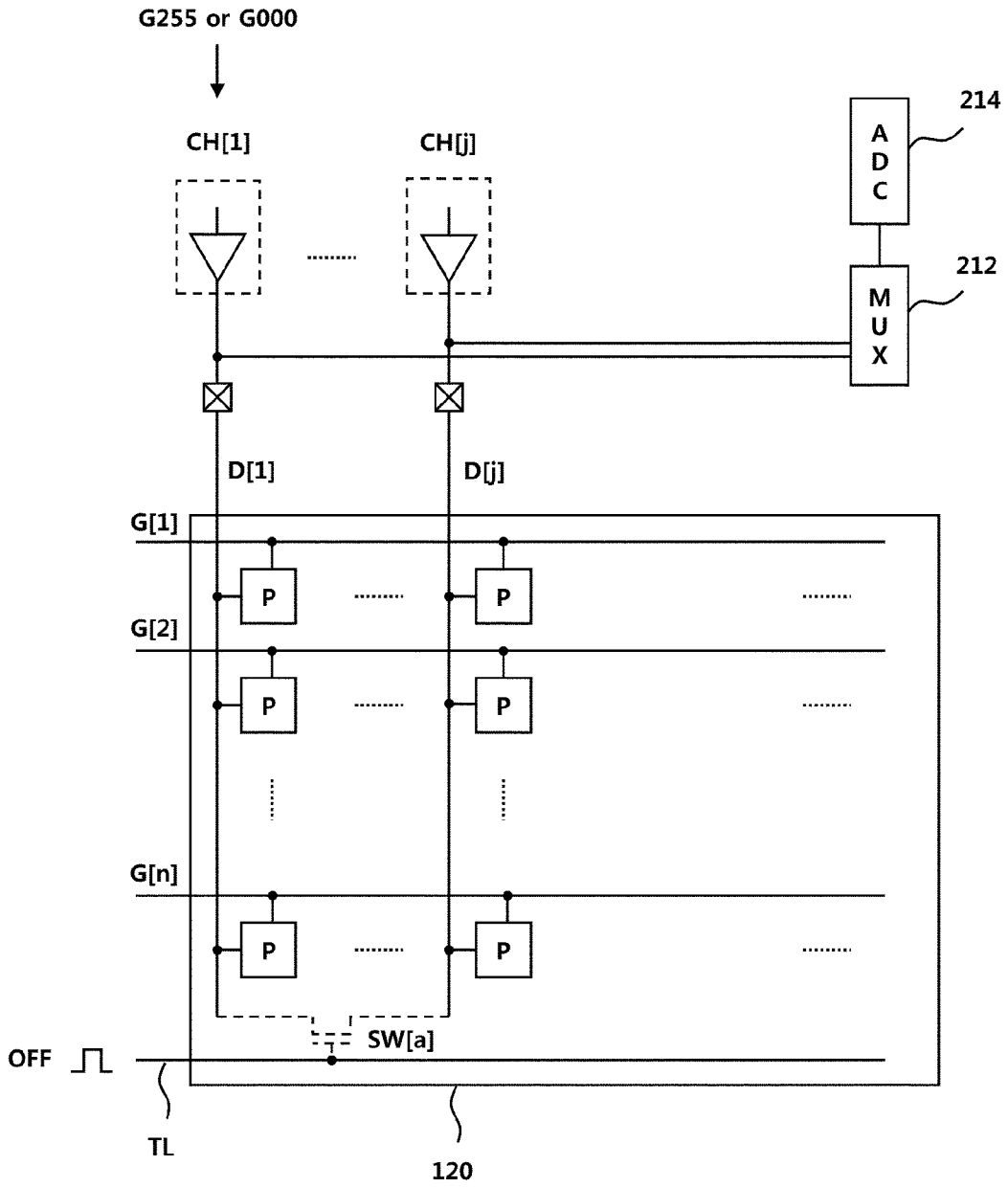
FIG. 6 is a diagram illustrating a fourth exemplary test state of a data driving device and a display panel according to a first embodiment.

FIG. 6 is a diagram illustrating a fourth exemplary test state of a data driving device and a display panel according to a first embodiment.

Referring to FIG. 6, in the fourth exemplary test state, a switch SW[a] of the connection circuit may disconnect two non-adjacent data lines from each other, unlike in the second exemplary test state. For example, the switch SW[a] may disconnect a first data line D[1] from a jth data line D[j] (j is a natural number equal to or higher than 3).

A testing process may be the same as that of the second exemplary test.

A data voltage may be supplied to one of the two non-adjacent data lines and a voltage of the other data line may be converted into first sensing data in the first test time. A data voltage may be supplied to the other data line and a voltage of the one data line may be converted into second sensing data in the second test time. Subsequently, the control circuit may determine short faults of the two data lines using the first sensing data and the second sensing data.

Meanwhile, in a case when an output terminal of a channel circuit to supply a data voltage is directly connected with the analog-digital converter in a state where all the switches of the connection circuit are turned off, the data driving device may determine the abnormality of the channel circuit.

In the example of FIG. 6, the selecting circuit 212 may connect an output terminal of a first channel circuit CH[1] with the analog-digital converter 214 in a state where the first channel circuit CH[1] outputs a first data voltage corresponding to a first greyscale value. The control circuit may compare a sensing value generated by the analog-digital converter 214 with the first greyscale value. If the two values correspond to each other, the first channel circuit CH[1] may be determined to be in a normal condition and, if not, the first channel circuit CH[1] may be determined to be in an abnormal condition.

Figure 7:
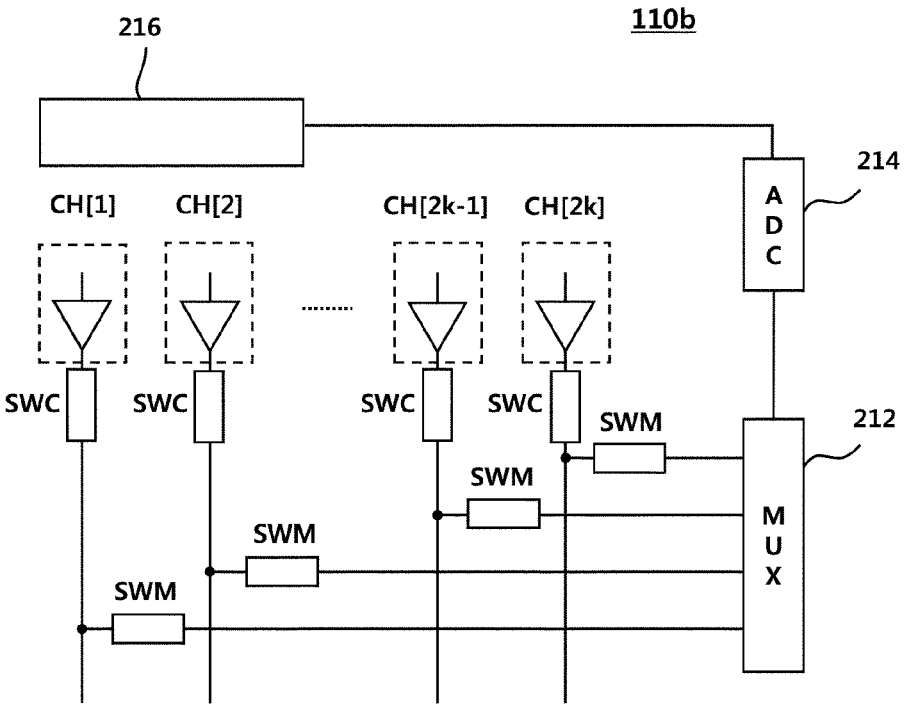
FIG. 7 is a configuration diagram of a data driving device according to a second embodiment.

FIG. 7 is a configuration diagram of a data driving device according to a second embodiment.

Referring to FIG. 7, a data driving device 110*b* according to a second embodiment may further comprise channel switches SWC and multiplexer (MUX) switches SWM in addition to the same elements as those of the data driving device (see 110*a* in FIG. 2) according to the first embodiment.

The channel switches may control the connection between the channel circuits CH[1], CH[2], . . . , CH[2k−1], CH[2k], . . . and the data lines. When the channel switches SWC are turned off, the channel circuits CH[1], CH[2], . . . , CH[2k−1], CH[2k], . . . may not be connected with the data lines and when the channel switches SWC are turned on, the channel circuits CH[1], CH[2], . . . , CH[2k−1], CH[2k], . . . may be connected with the data line.

The MUX switches SWM may control the connection between the selecting circuit 212 and the data lines. When the MUX switches SWM are turned off, the selecting circuit 212 may not be connected with the data lines and when the MUX switches SWM are turned on, the selecting circuit 212 may be connected with the data lines.

The channel switches SWC and the MUX switches SWM may be disposed in the respective data lines and only one of a channel switch SWC and a MUX switch SWM may be turned on in each data line.

Figure 8:
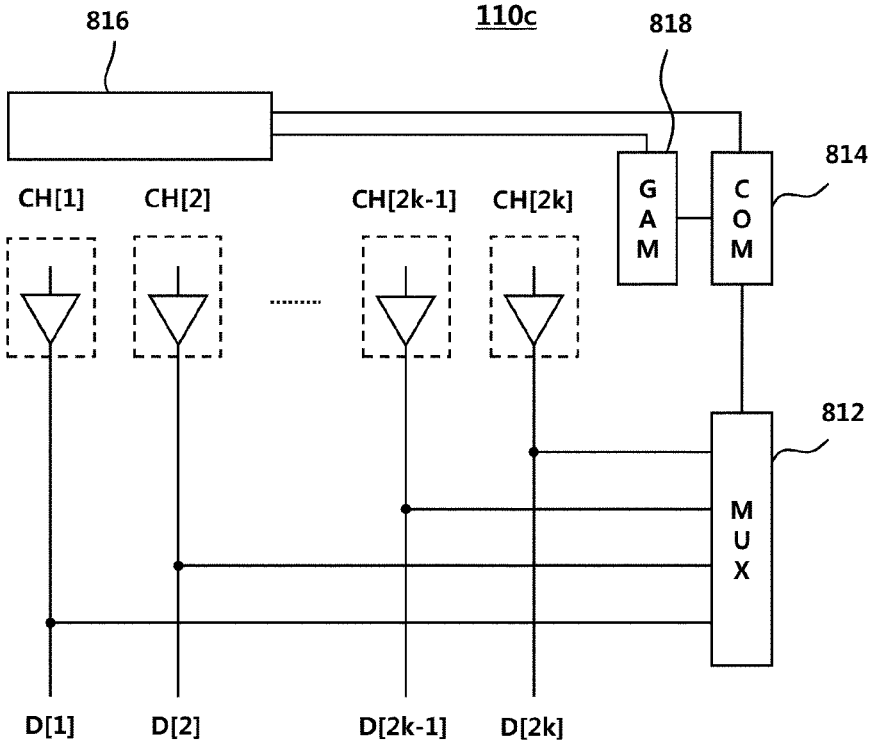
FIG. 8 is a configuration diagram of a data driving device according to a third embodiment.

FIG. 8 is a configuration diagram of a data driving device according to a third embodiment.

Referring to FIG. 8, a data driving device 110*c* may comprise a plurality of channel circuits CH[1], CH[2], . . . , CH[2k−1], CH[2k], . . . , a selecting circuit 812, a comparator 814, a gamma voltage circuit 818, and a control circuit 816.

The gamma voltage circuit 818 may supply a plurality of gamma voltages. The channel circuits CH[1], CH[2], . . . , CH[2k−1], CH[2k], . . . may select one of the plurality of gamma voltages according to a greyscale value to generate a data voltage.

An operating method of the data driving device 110*c* in the third embodiment may be similar to that of the data driving device in the first embodiment. One channel circuit may supply a data voltage to one data line and the control circuit 816 may determine a fault of the one data line or a fault of another data line according to a voltage of the other data line.

For example, a first channel circuit CH[1] may select a voltage corresponding to a first greyscale value among the plurality of gamma voltages to generate a first data voltage. Subsequently, the first channel circuit CH[1] may supply the first data voltage to a first data line D[1] and the selecting circuit 812 may connect a second data line D[2] with the comparator 814.

The comparator 814 may select a voltage corresponding to a first reference greyscale value among the plurality of gamma voltages to generate a first reference voltage. Subsequently, the comparator 814 may compare a voltage of the second data line D[2] with the first reference voltage. The control circuit 816 may determine a fault of the first data line D[1] or a fault of the second data line D[2] according to an output of the comparator 814.

In a case when the first data line D[1] and the second data line D[2] are connected with each other by the connection circuit disposed on the display panel as the case of the first embodiment, the control circuit 816 may determine an open fault of the first data line D[1] or an open fault of the second data line D[2] according to the output of the comparator 814. In a case when the first data line D[1] and the second data line D[2] are disconnected from each other by the connection circuit disposed on the display panel, the control circuit 816 may determine a short fault of the first data line D[1] or a short fault of the second data line D[2] according to the output of the comparator 814.

The first reference greyscale value may be less than the first greyscale value by a predetermined amount. The first reference greyscale value may be determined in consideration of the voltage drop due to a resistance of a data line.

Figure 9:
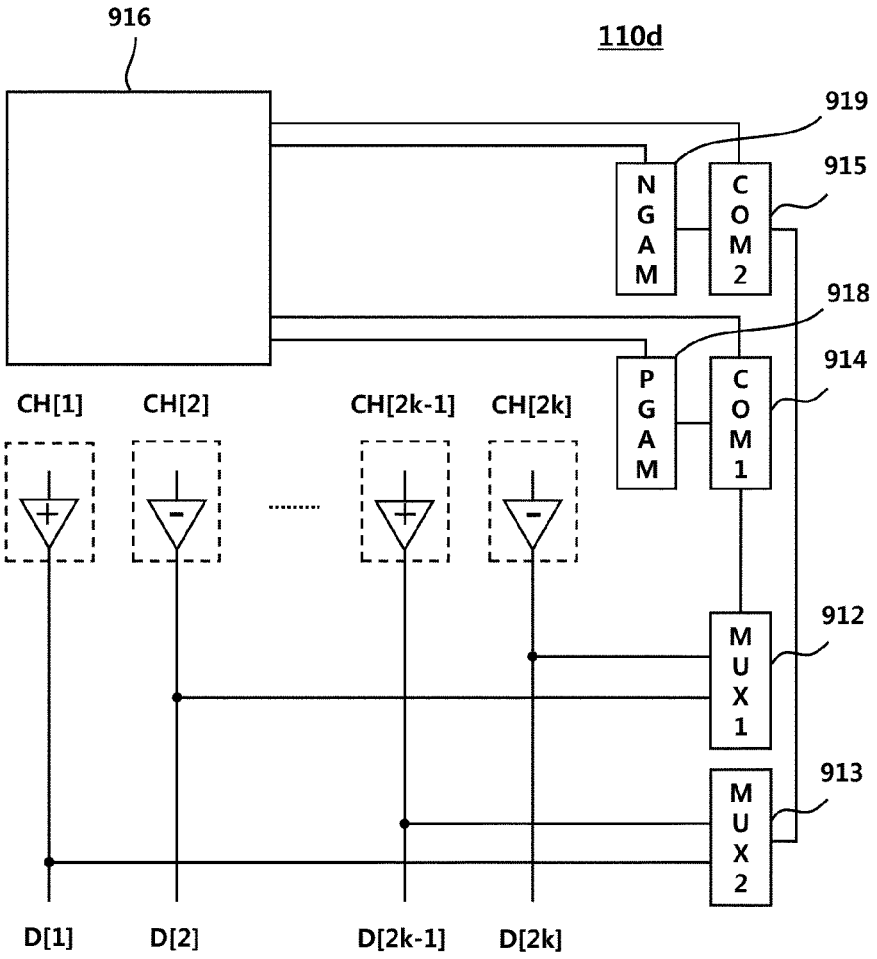
FIG. 9 is a configuration diagram of a data driving device according to a fourth embodiment.

FIG. 9 is a configuration diagram of a data driving device according to a fourth embodiment.

Referring to FIG. 9, a data driving device 110*d* may further comprise polarities in addition to the same elements as those of the third embodiment.

Some of channel circuits CH[1], CH[2], . . . , CH[2k−1], CH[2k], . . . may supply data voltages of a positive polarity and others may supply data voltage of a negative polarity. The positive polarity and the negative polarity may be related to a technique applied to, for example, a liquid crystal display device. A channel circuit having a positive polarity may output a data voltage higher than a common voltage for a same greyscale value, whereas a channel circuit having a negative polarity may output a data voltage lower than the common voltage for a same greyscale value.

Odd-numbered channel circuits CH[2k−1] may have a positive polarity and even-numbered channel circuits CH[2k] may have a negative polarity.

The gamma voltage circuit may comprise a P gamma voltage circuit 918 and an N gamma voltage circuit 919 to supply gamma voltages of different polarities.

The P gamma voltage circuit 918 may supply gamma voltages having a positive polarity and the odd-numbered channel circuits CH[2k−1] may generate data voltages using the P gamma voltage circuit 918. The N gamma voltage circuit 919 may supply gamma voltages having a negative polarity and the even-numbered channel circuits CH[2k] may generate data voltages using the N gamma voltage circuit 919.

The data driving device 110*d* may determine faults of data lines using all of the data voltages of the positive polarity and the data voltages of the negative polarity.

For example, in a first test time, a first channel circuit CH[1] may supply a first data voltage corresponding to a first greyscale value to a first data line D[1]. Here, the first channel circuit CH[1] may supply a data voltage of the positive polarity using the P gamma voltage circuit 918. A first selecting circuit 912 may connect a second data line D[2] with a first comparator 914. The first comparator 914 may select a voltage corresponding to a first reference greyscale value among a plurality of gamma voltages, supplied by the P gamma voltage circuit 918, to generate a first reference voltage and compare the first reference voltage with a voltage of the second data line D[2].

In a second test time, a second channel circuit CH[2] may supply a second data voltage corresponding to a second greyscale value to the second data line D[2]. Here, the second channel circuit CH[2] may supply a data voltage of the negative polarity using the N gamma voltage circuit 919. A second selecting circuit 913 may connect the first data line D[1] with a second comparator 915. The second comparator 915 may select a voltage corresponding to a second reference greyscale value among a plurality of gamma voltages, supplied by the N gamma voltage circuit 919, to generate a second reference voltage and compare the second reference voltage with a voltage of the first data line D[1].

A control circuit 916 may determine a fault of the first data line D[1] or a fault of the second data line D[2].

Figure 10:
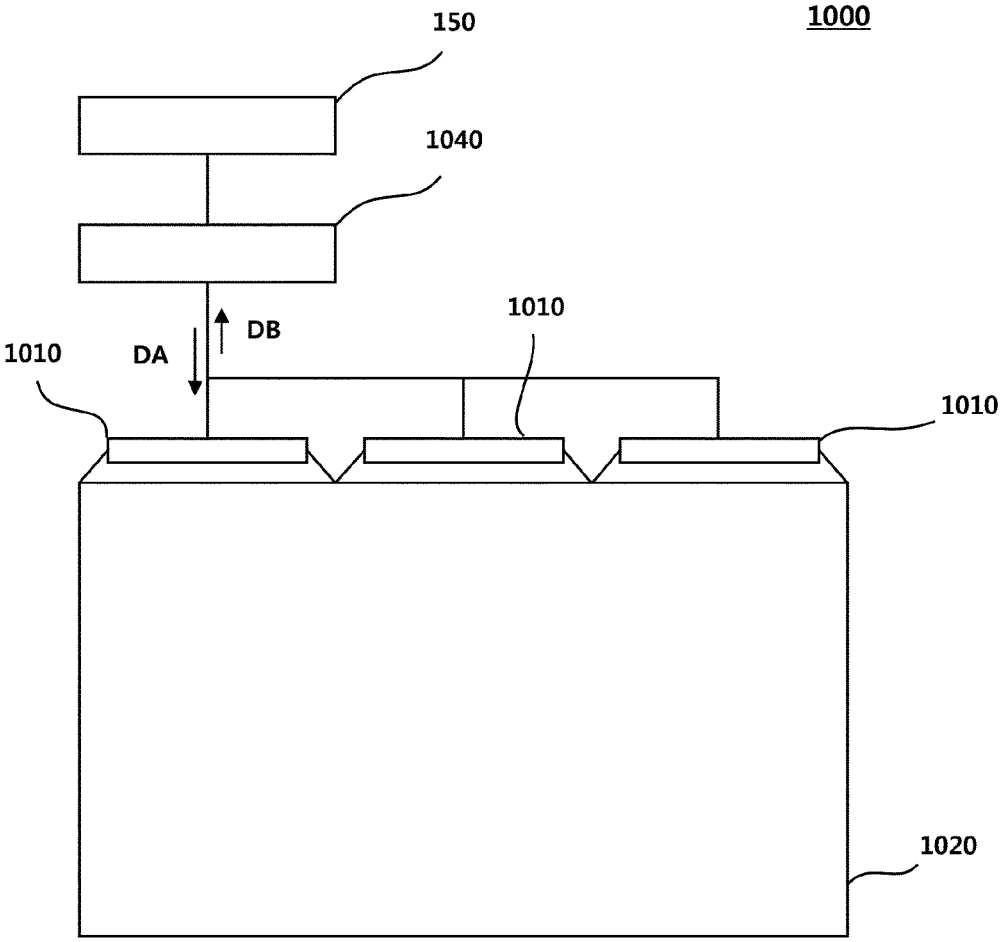
FIG. 10 is a configuration diagram of a display device according to a fifth embodiment and a sixth embodiment.

FIG. 10 is a configuration diagram of a display device according to a fifth embodiment and a sixth embodiment.

Referring to FIG. 10, a display device 1000 may comprise a display panel 1020, a data driving device 1010, a data processing device 1040, and a host device 150.

When comparing the display device 1000 according to the fifth and the sixth embodiments with the display device according to the first embodiment, the display panel 1020 may not comprise a connection circuit. Accordingly, the display device 1000 according to the fifth and the sixth embodiments may not comprise the level shifter comprised in the display device according to the first embodiment and the data processing device 1040 may not generate a control signal for the level shifter.

The data driving device 1010 may receive image data DA from the data processing device 1040, drive data lines disposed on the display panel 1020, and display an image through pixels. In addition, the data driving device 1010 may determine faults of the data lines and transmit state determination data DB to the data processing device 1040.

Figure 11:
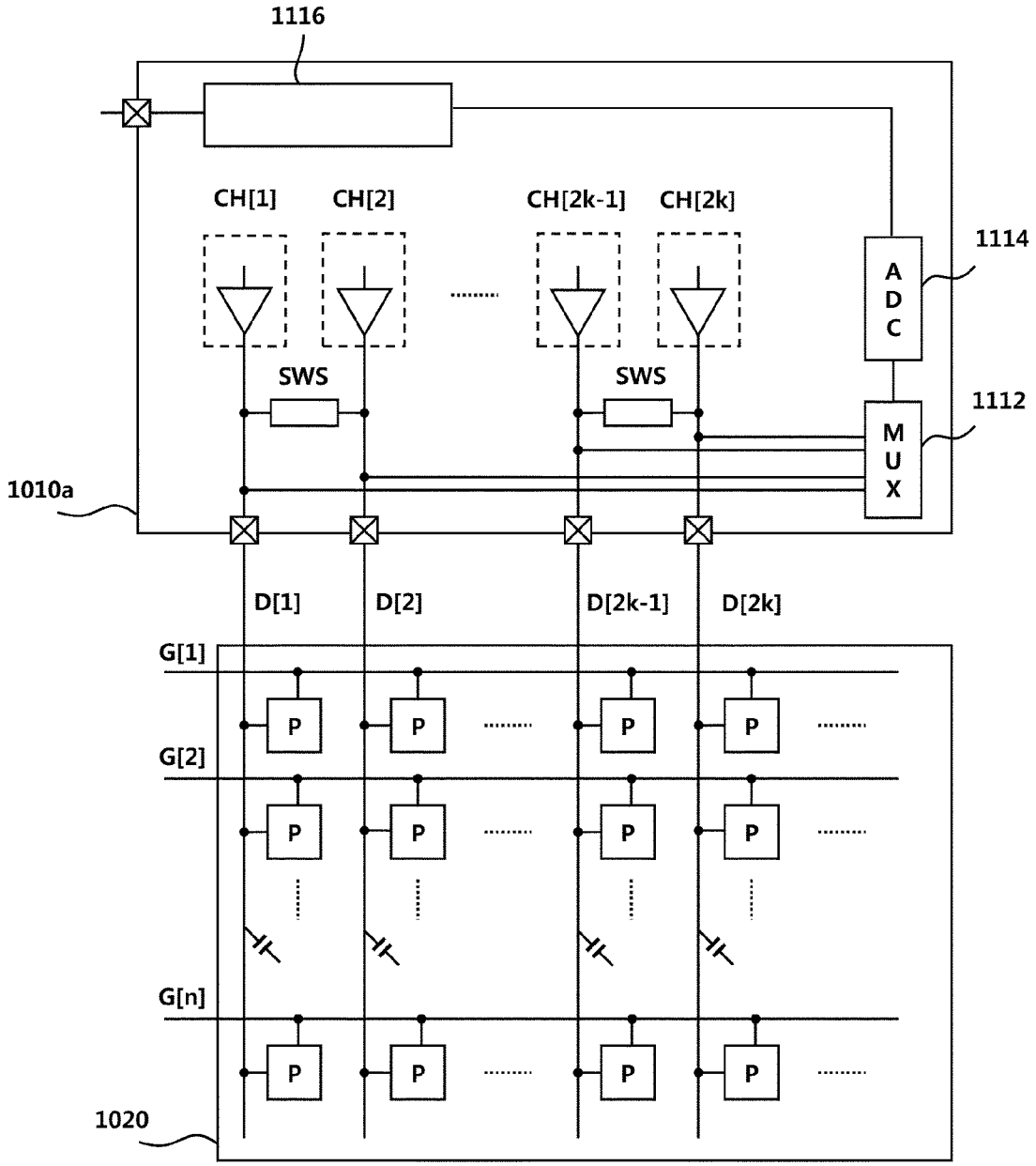
FIG. 11 is a configuration diagram of a data driving device and a display device according to a fifth embodiment.

FIG. 11 is a configuration diagram of a data driving device and a display device according to a fifth embodiment.

Referring to FIG. 11, a data driving device 1010*a* may comprise a plurality of channel circuits CH[1], CH[2], . . . , CH[2k−1], CH[2k], . . . , a selecting circuit 1112, an analog-digital converter 1114, and a control circuit 1116. On a display panel 1020, a plurality of gate lines G[1], G[2], . . . , G[n] and a plurality of data lines D[1], D[2], . . . , D[2k−1], D[2k], . . . are disposed and pixels P may be disposed at intersection points of the gate lines G[1], G[2], . . . , G[n] and the data lines D[1], D[2], . . . , D[2k−1], D[2k], . . . . In addition, capacitances may be formed between the data lines D[1], D[2], . . . , D[2k−1], D[2k], . . . and surrounding electrodes.

Every two of the channel circuits CH[1], CH[2], . . . , CH[2k−1], CH[2k], . . . may make a pair and outputs of the two channel circuits making a pair may be connected with each other or be disconnected from each other by a charge sharing switch SWS. Two channel circuits making a pair may be adjacent or not. For the convenience of description, the description will be made hereinafter under the assumption that a first channel circuit CH[1] and a second channel circuit CH[2] make a pair.

The first channel circuit CH[1] may supply a first data voltage corresponding to a first greyscale value to a first data line during a first charging time. At this time, the second channel circuit CH[2] may supply a second data voltage corresponding to a second greyscale value to a second data line D[2]. In the first charging time, a first capacitance formed in the first data line D[1] may be charged with the first data voltage and a second capacitance formed in the second data line D[2] may be charged with the second data voltage.

In a mode where an image is displayed on the display panel 1020, the first channel circuit CH[1] and the second channel circuit CH[2] may change lines of pixels in every 1H (horizontal) time when driving pixels. The first capacitance and the second capacitance may be completely charged before the 1H time has elapsed.

In a mode where faults are determined, the first channel circuit CH[1] and the second channel circuit CH[2] may set the first charging time to be equal to or more than the 1H time in order that the first capacitance may be completely charged with the first data voltage and the second capacitance may be completely charged with the second data voltage.

After the first charging time has elapsed, the first channel circuit CH[1] and the second channel circuit CH[2] may stop supplying data voltages. Subsequently, a charge sharing switch SWS is turned on so that the first data line D[1] and the second data line D[2] may be connected with each other. At this time, the first data line D[1] and the second data line D[2] may be in a charge sharing state.

In the charge sharing state, a selecting circuit 1112 may connect either the first data line D[1] or the second data line D[2] with an analog-digital converter 1114. The analog-digital converter 1114 may convert a measured value of a voltage of the first data line D[1] or a voltage of the second data line D[2] into sensing data. A control circuit 1116 may determine an open fault of the first data line D[1] or an open fault of the second data line D[2] using the measured value, the first greyscale value, and the second greyscale value.

The first data voltage and the second data voltage may be different and the first capacitance and the second capacitance may be substantially identical or similar to each other to the extent that their difference is within a predetermined range. In a case when the first data line D[1] and the second data line D[2] are in a normal condition, a voltage of the first data line D[1] or a voltage of the second data line D[2] measured by the analog-digital converter 1114 may have an intermediate level of the first data voltage and the second data voltage. If the voltage of the first data line D[1] or the voltage of the second data line D[2] measured by the analog-digital converter 1114 is different from a predicted voltage, a control circuit 1116 may determine an open fault of the first data line D[1] or an open fault of the second data line D[2].

Figure 12:
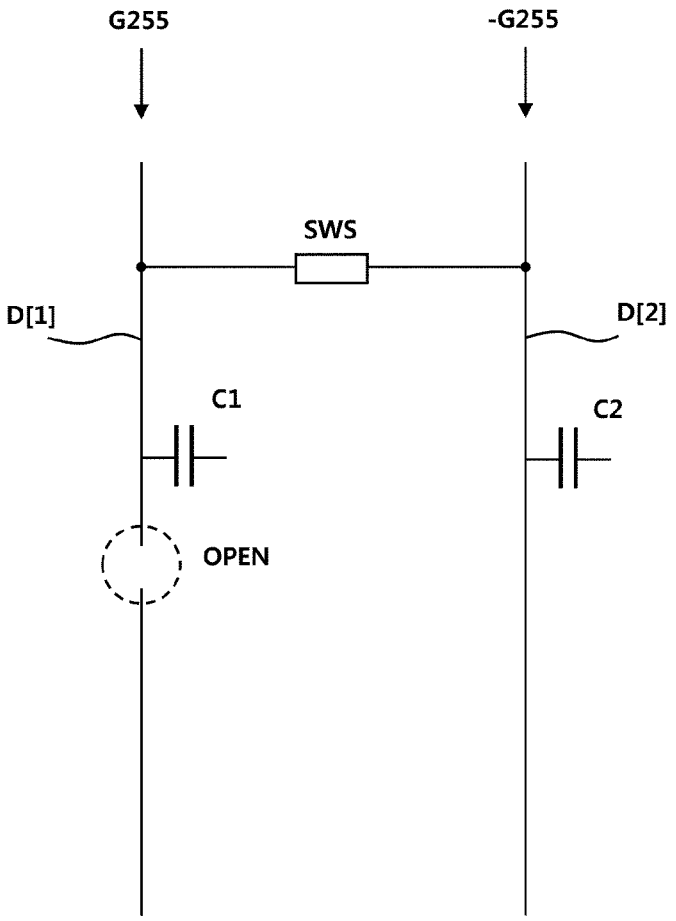
FIG. 12 is a diagram illustrating a case when an open fault occurs in a first data line.

FIG. 12 is a diagram illustrating a case when an open fault occurs in a first data line.

When the first data line D[1] has an open fault, a first capacitance C1 formed in the first data line D[1] may be reduced. In this state, a first data voltage corresponding to a first greyscale value G255, for example, a voltage of 12V may be supplied to the first data line D[1] and a second data voltage corresponding to a second greyscale value −G255, for example, a voltage of 0V may be supplied. Then, when the first data line D[1] and the second data line D[2] share charges, a voltage of the first data line D[1] or a voltage of the second data line D[2] may have a level closer to that of the second data voltage than that of the first data voltage, for example, 4V.

The first data voltage may be higher than the second data voltage. The control circuit may set a reference voltage between the first data voltage and the second data voltage, for example, set the reference voltage to be 6V and determine an open fault of the first data line D[1] if a voltage measured in the first data line D[1] or a voltage measured in the second data line D[2] is lower than the reference voltage.

Figure 13:
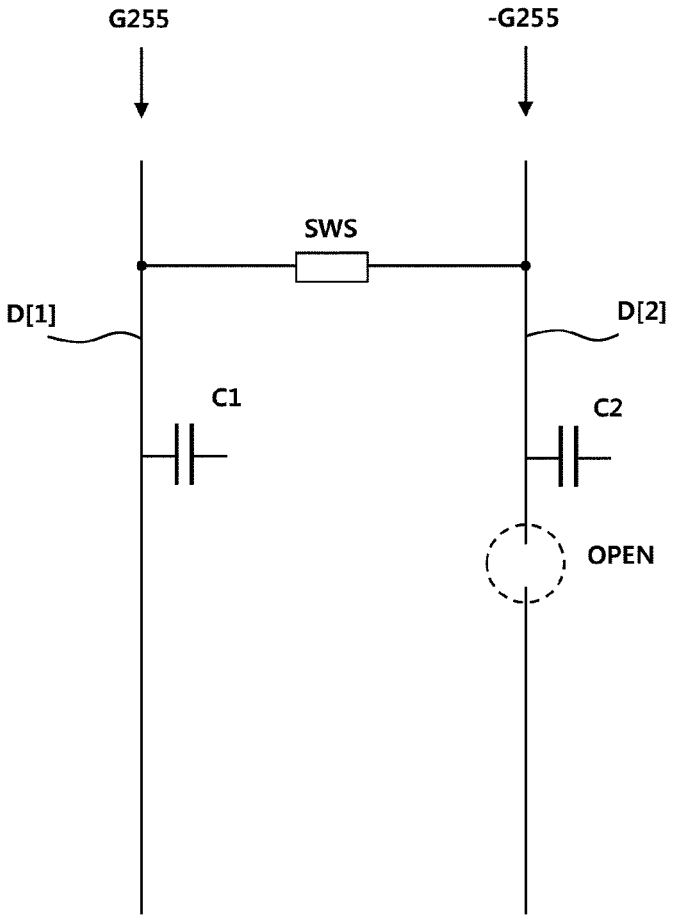
FIG. 13 is a diagram illustrating a case when an open fault occurs in a second data line.

FIG. 13 is a diagram illustrating a case when an open fault occurs in a second data line.

When the second data line D[2] has an open fault, a second capacitance C2 formed in the second data line D[2] may be reduced. In this state, a second data voltage corresponding to a second greyscale value −G255, for example, a voltage of 0V may be supplied to the second data line D[2] and a first data voltage corresponding to a first greyscale value G255, for example, a voltage of 12V may be supplied. Then, when the first data line D[1] and the second data line D[2] share charges, a voltage of the first data line D[1] or a voltage of the second data line D[2] may have a level closer to that of the first data voltage than that of the second data voltage, for example, 8V.

The first data voltage may be higher than the second data voltage. The control circuit may set a reference voltage between the first data voltage and the second data voltage, for example, it may set the reference voltage to be 6V and determine an open fault of the second data line D[2] if a voltage measured in the first data line D[1] or a voltage measured in the second data line D[2] is higher than the reference voltage.

Figure 14:
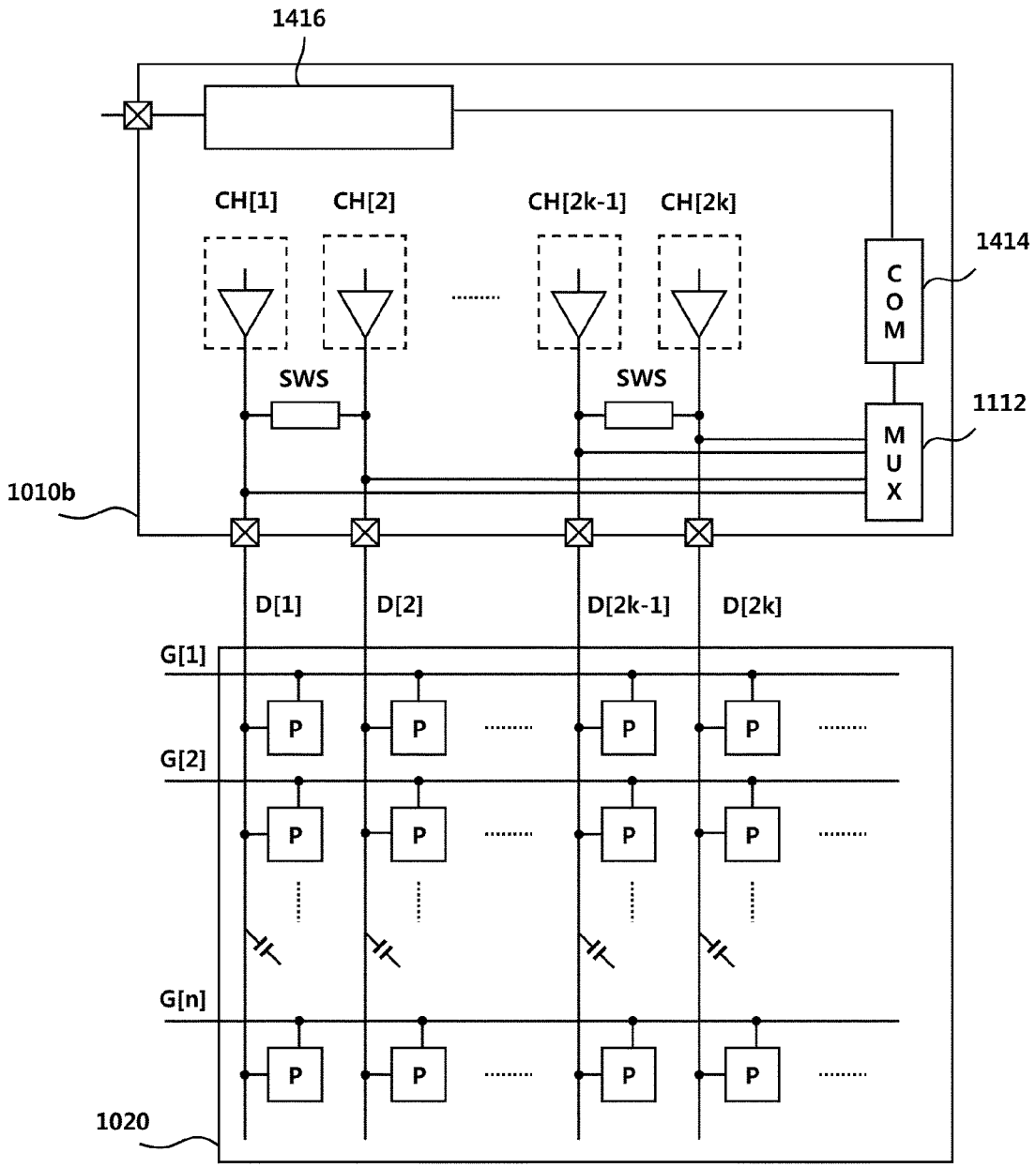
FIG. 14 is a configuration diagram of a data driving device and a display device according to a sixth embodiment.

FIG. 14 is a configuration diagram of a data driving device and a display device according to a sixth embodiment.

Referring to FIG. 14, a data driving device 1010*b* may comprise a comparator 1414 instead of the analog-digital converter of the data driving device according to the fifth embodiment. Otherwise, the data driving device 1010*b* may comprise the comparator 1414 in addition to the analog-digital converter.

A first channel circuit CH[1] may supply a first data voltage corresponding to a first greyscale value to a first data line D[1] during a first charging time. At this time, a second channel circuit CH[2] may supply a second data voltage corresponding to a second greyscale value to a second data line D[2]. In the first charging time, a first capacitance formed in the first data line D[1] may be charged by the first data voltage and a second capacitance formed in the second data line D[2] may be charged by the second data voltage.

After the first charging time has elapsed, the first channel circuit CH[1] and the second channel circuit CH[2] may stop supplying data voltages. Subsequently, a charge sharing switch SWS is turned on so that the first data line D[1] and the second data line D[2] may be connected with each other. At this time, the first data line D[1] and the second data line D[2] may be in a charge sharing state.

In the charge sharing state, a selecting circuit 1112 may connect the first data line D[1] or the second data line D[2] with the comparator 1414. The comparator 1414 may compare a voltage of the first data line D[1] or a voltage of the second data line D[2] with a reference voltage. A control circuit 1116 may determine an open fault of the first data line D[1] or an open fault of the second data line D[2] using an output from the comparator 1414.

The first data voltage and the second data voltage may be different and the first capacitance and the second capacitance may be substantially identical or similar to each other to the extent that their difference is within a predetermined range. In a case when the first data line D[1] and the second data line D[2] are in a normal condition, the voltage of the first data line D[1] or the voltage of the second data line D[2] inputted into the comparator 1414 may have a level intermediate between the levels of the first data voltage and the second data voltage. If the voltage of the first data line D[1] or the voltage of the second data line D[2] is different from the reference voltage, a control circuit 1416 may determine an open fault of the first data line D[1] or an open fault of the second data line D[2].

The reference voltage may be set between the first data voltage and the second data voltage. Through one terminal of the comparator 1414, the reference voltage may be inputted and, through another terminal of the comparator 1414, a voltage measured in the first data line D[1] and a voltage measured in the second data line D[2] may be inputted.

Figure 15:
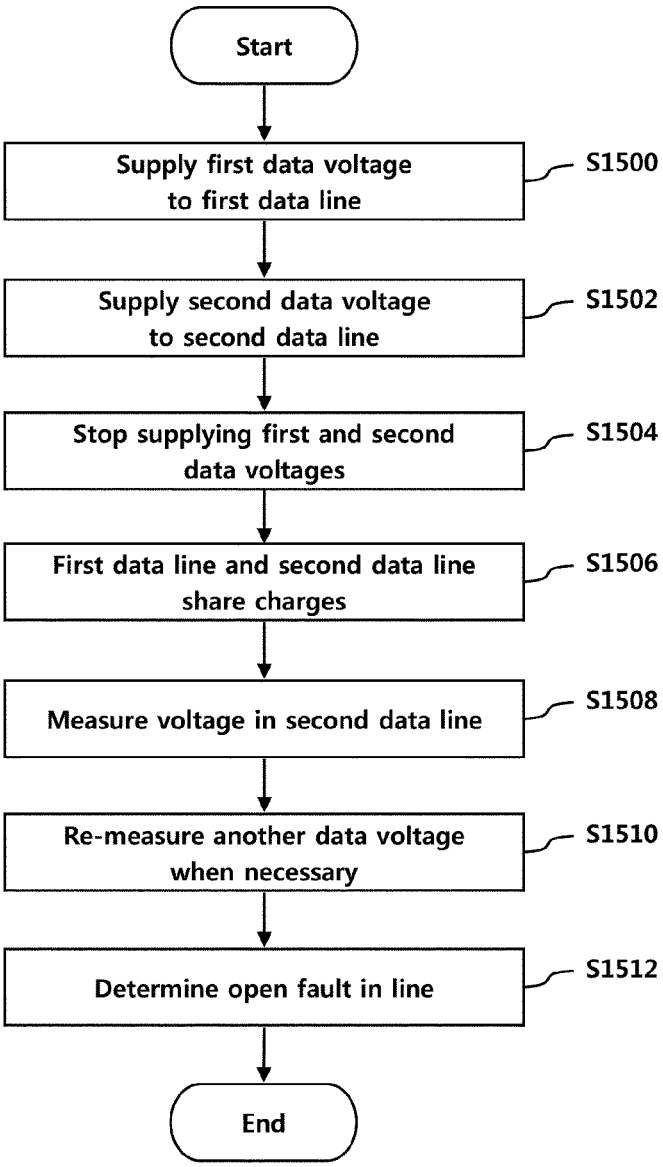
FIG. 15 is a flow diagram of a method in which a data driving device determines a fault state of a data line.

FIG. 15 is a flow diagram of a method in which a data driving device determines a fault state of a data line.

Referring to FIG. 15, a data driving device may supply a first data voltage corresponding to a first greyscale value to a first data line (S1500) and a second data voltage corresponding to a second greyscale value to a second data line (S1502). The first data voltage and the second data voltage may be supplied during at least a 1H time.

Subsequently, the data driving device may stop supplying the first data voltage and the second data voltage (S1504) and connect the first data line and the second data line (S1506). The connection between the first data line and the second data line allows a charge sharing of the first data line and the second data line.

The data driving device may measure a voltage of the first data line or a voltage of the second data line to obtain a first measured voltage (S1510).

The data driving device may determine an open fault of the first data line or an open fault of the second data line according to the first measured voltage (S1512).

The data driving device may perform a re-measurement using other data voltages as necessary (S1510). For example, the data driving device may supply a third data voltage corresponding to a third greyscale value to the first data line and a fourth data voltage corresponding to a fourth greyscale value to the second data line. Subsequently, the data driving device may stop supplying the third data voltage and the fourth data voltage, connect the first data line and the second data line, and measure a voltage of the first data line and a voltage of a second data line, thereby obtaining a second measured voltage. Here, the first data voltage and the second data voltage may respectively have levels different from each other and the third data voltage and the fourth data voltage may respectively have levels different from each other.

The data driving device may determine an open fault of the first data line or an open fault of the second data line using the first measured voltage and the second measured voltage.

In the above-described embodiments, the determination of a fault state of each data line or a pair of data lines may be repeated in order to increase the accuracy of the determination. In the above-described embodiments, the data driving device may vary a data voltage supplied to each data line while repeating tests for the determination of the fault state multiple times. Since the data voltage may easily be changed by changing a greyscale value for a test, the data driving device may perform tests multiple times by changing the greyscale value. In addition, the data driving device may repeat tests multiple times without changing the data voltage so as to minimize the influence of noise.

As described above, according to the present disclosure, tests for a display panel may be performed using a device for driving the display panel and this allows a testing method to be simple and manufacturing costs to be reduced.

What is claimed is:

1. A device for driving a display panel in which data lines are disposed, the device comprising:

a first channel circuit to supply a first data voltage corresponding to a first greyscale value to a first data line;

a second channel circuit to supply a second data voltage corresponding to a second greyscale value to a second data line;

a connection circuit to connect between the first data line and the second data line according to a control signal;

a selecting circuit to selectively connect a data line of the first data line and the second data line; and a control circuit to determine a fault of the first data line or a fault of the second data line according to sensing data from a voltage of the data line selectively connected by the selecting circuit, in a state where the first data line and the second data line are connected with each other by the connection circuit, wherein the selecting circuit selects the second data line when a data voltage for a test is supplied to the first data line in a first test time.

2. The device of claim 1, wherein the first data voltage and the second data voltage stop being supplied before the first data line and the second data line are connected with each other.

3. The device of claim 1, wherein the first data voltage has a higher level than that of the second data voltage.

4. The device of claim 1, wherein a reference voltage is set between the first data voltage and the second data voltage and the control circuit determines an open fault of the first data line when either a voltage measured in the first data line or a voltage measured in the second data line has a lower level than that of the reference voltage.

5. The device of claim 3, further comprising a comparator, wherein a reference voltage is set between the first data voltage and the second data voltage, the reference voltage is inputted through one terminal of the comparator and one of measured voltages is inputted through another terminal thereof, and the control circuit determines an open fault of the first data line or an open fault of the second data line according to an output of the comparator.

6. The device of claim 1, further comprising an analog-digital converter, wherein the control circuit determines an open fault of the first data line or an open fault of the second data line using a value converted from the voltage measured in the first data line by the analog-digital converter, the first greyscale value, and the second greyscale value.

7. The device of claim 2, wherein, in a mode where an image is displayed on the display panel, the first channel circuit and the second channel circuit change lines of pixels in every 1H (horizontal) time when driving pixels and, in a mode where the open fault is determined, the first channel circuit and the second channel circuit respectively supply the first data voltage and the second data voltage during at least a 1H time.

8. The device of claim 1, wherein the first channel circuit changes the first greyscale value multiple times and the control circuit determines an open fault of the first data line according to a changed first greyscale value multiple times.

9. The device of claim 1, wherein the first channel circuit supplies a third data voltage corresponding to a third greyscale value to the first data line, the second channel circuit supplies a fourth data voltage corresponding to a fourth greyscale value to the second data line, the connection circuit connects the first data line and the second data line with each other after the third data voltage and the fourth data voltage stops being supplied, and the control circuit determines an open fault of the first data line using a voltage measured in the first data line in a test for the first greyscale value and a voltage measured in the first data line in a test for the third greyscale value.

10. The device of claim 9, wherein the first data voltage and the second data voltage respectively have different levels and the third data voltage and the fourth data voltage respectively have different levels.

11. The device of claim 1, wherein the selecting circuit connects the second data line with the control circuit when the first data voltage is supplied to the first data line and the control circuit determines a fault of the first data line or a fault of the second data line according to sensing data from a voltage of the second data line.

12. The device of claim 1, wherein the control circuit determines an open fault of the first data line or an open fault of the second data line, in a state where the first data line and the second data line are connected with each other by the connection circuit.

13. The device of claim 1, wherein the control circuit determines a short fault of the first data line or a short fault of the second data line, in a state where the first data line and the second data line are disconnected from each other by the connection circuit.

14. The device of claim 1, wherein the connection circuit comprises a switch, and the switch is disposed on the opposite side to a side where the first channel circuit is disposed in a longitudinal direction of the first data line.

15. The device of claim 1, further comprising:

an analog-digital converter, wherein the selecting circuit connects the first data line with the analog-digital converter when the second data voltage is supplied to the second data line and the control circuit determines a fault of the first data line or a fault of the second data line according to sensing data from a voltage of the first data line.

16. A device for driving a display panel in which data lines are disposed, the device comprising:

a gamma voltage circuit to supply a plurality of gamma voltages;

a first channel circuit to generate a first data voltage by selecting a voltage corresponding to a first greyscale value among the plurality of gamma voltages and to supply the first data voltage to a first data line;

a first comparator to generate a first reference voltage by selecting a voltage corresponding to a first reference greyscale value among the plurality of gamma voltages and to compare the first reference voltage with a voltage of a second data line; and a control circuit to determine a fault of the first data line or a fault of the second data line according to an output of the first comparator, wherein the display panel comprises a connection circuit to control connection between the first data line and the second data line.

17. The device of claim 16, wherein the control circuit determines an open fault of the first data line or an open fault of the second data line, in a state where the first data line and the second data line are connected with each other by the connection circuit.

18. The device of claim 16, wherein the first reference greyscale value is less than the first greyscale value by a predetermined amount.

19. The device of claim 16, further comprising:

a second channel circuit to supply a second data voltage corresponding to a second greyscale value to the second data line, wherein the gamma voltage circuit comprises a P gamma voltage circuit and an N gamma voltage circuit respectively supplying gamma voltages of different polarities, the first channel circuit generates the first data voltage using the P gamma voltage circuit, and the second channel circuit generates the second data voltage using the N gamma voltage circuit.

20. The device of claim 19, further comprising:

a second comparator to generate a second reference voltage using the N gamma voltage circuit and to compare a voltage of the first data line with the second reference voltage, wherein the control circuit determines a fault of the first data line or a fault of the second data line according to an output of the first comparator and an output of the second comparator.

* * * * *